US008052300B2

(12) United States Patent
Zhang et al.

(10) Patent No.: US 8,052,300 B2
(45) Date of Patent: Nov. 8, 2011

(54) LED LAMP INCLUDING LED MOUNTS WITH FIN ARRAYS

(75) Inventors: Yi Zhang, Shenzhen (CN); Jin-Song Feng, Shenzhen (CN); Cheng-Tien Lai, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 514 days.

(21) Appl. No.: 12/274,358

(22) Filed: Nov. 20, 2008

(65) Prior Publication Data

US 2009/0323347 A1 Dec. 31, 2009

(30) Foreign Application Priority Data

Jun. 25, 2008 (CN) ..... 2008 10 068115

(51) Int. Cl.
*F21S 4/00* (2006.01)
*F21V 29/00* (2006.01)

(52) U.S. Cl. ..... 362/249.02; 362/249.11; 362/294; 362/249.06; 362/800

(58) Field of Classification Search ..... 362/545, 362/547, 218, 249.02, 249.06, 249.11, 294, 362/373

See application file for complete search history.

(56) References Cited

U.S. PATENT DOCUMENTS

| | | | | |
|---|---|---|---|---|
| 7,637,636 | B2 * | 12/2009 | Zheng et al. | 362/294 |
| 7,654,701 | B2 * | 2/2010 | Zhang et al. | 362/294 |
| 7,695,161 | B2 * | 4/2010 | Zhang et al. | 362/294 |
| 7,717,587 | B2 * | 5/2010 | Lin et al. | 362/249.06 |
| 7,766,510 | B2 * | 8/2010 | Lee | 362/249.02 |
| 2005/0047170 | A1 * | 3/2005 | Hilburger et al. | 362/547 |
| 2005/0152146 | A1 * | 7/2005 | Owen et al. | 362/294 |
| 2008/0170400 | A1 * | 7/2008 | Maruyama | 362/294 |
| 2008/0174963 | A1 * | 7/2008 | Chang et al. | 361/700 |
| 2008/0316755 | A1 * | 12/2008 | Zheng et al. | 362/373 |
| 2009/0095959 | A1 * | 4/2009 | Lai et al. | 257/79 |
| 2009/0129103 | A1 * | 5/2009 | Zhang et al. | 362/373 |

FOREIGN PATENT DOCUMENTS

| | | |
|---|---|---|
| CN | 201017875 Y | 2/2008 |
| JP | 200563754 A | 3/2005 |

* cited by examiner

*Primary Examiner* — Ismael Negron
(74) *Attorney, Agent, or Firm* — Altis Law Group, Inc.

(57) ABSTRACT

An LED lamp includes a heat sink, a plurality of fin arrays mounted on the heat sink, and a plurality of LED modules mounted on the fin arrays. The heat sink includes a base and a plurality of heat dissipating fins extending from the base. The fin arrays are mounted on a top surface of the base of the heat sink. Each fin array consists of a plurality of fins interlocked together. Each fin array has a bottom mounting surface in contact with the top surface of the base and a top engaging surface defined at an acute angle with respect to the top surface of the base. The LED modules are mounted on the engaging surfaces of the fin arrays, respectively, via heat absorbing plates.

18 Claims, 4 Drawing Sheets

LED LAMP INCLUDING LED MOUNTS WITH FIN ARRAYS

BACKGROUND OF THE INVENTION

1. Field of the Invention

The disclosure relates to LEDs, and more particularly to an LED lamp providing a wide illumination area.

2. Description of Related Art

The technology of light emitting diodes has been rapidly developed in recent years, allowing expansion of application from indicators to include illumination. With the features of long-term reliability, environment friendliness and low power consumption, the LED is viewed as a promising alternative for recent lighting products.

A conventional LED lamp comprises a heat sink and a plurality of LED modules having LEDs, attached to an outer surface of the heat sink to dissipate heat generated by the LEDs. The outer surface of the heat sink is generally planar with the LEDs arranged closely. However, such LEDs mounting on the planar outer surface of the heat sink provides only a planar light source.

What is needed, therefore, is an LED lamp providing a sufficiently wide illumination area to function as a three-dimensional light source.

SUMMARY OF THE INVENTION

An LED lamp includes a heat sink, a plurality of fin arrays mounted on the heat sink, and a plurality of LED modules mounted on the fin arrays. The heat sink includes a base and a plurality of dissipating fins extending from the base. The fin arrays are mounted on a top surface of the base of the heat sink. Each fin array has a bottom mounting surface in contact with the top surface of the base and a top engaging surface at an acute angle with respect to the top surface of the base. The LED modules are mounted on the engaging surfaces of the fin arrays, respectively. Each fin array comprises a plurality of fins parallel and spaced apart. A plurality of air passages are defined between the fins.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
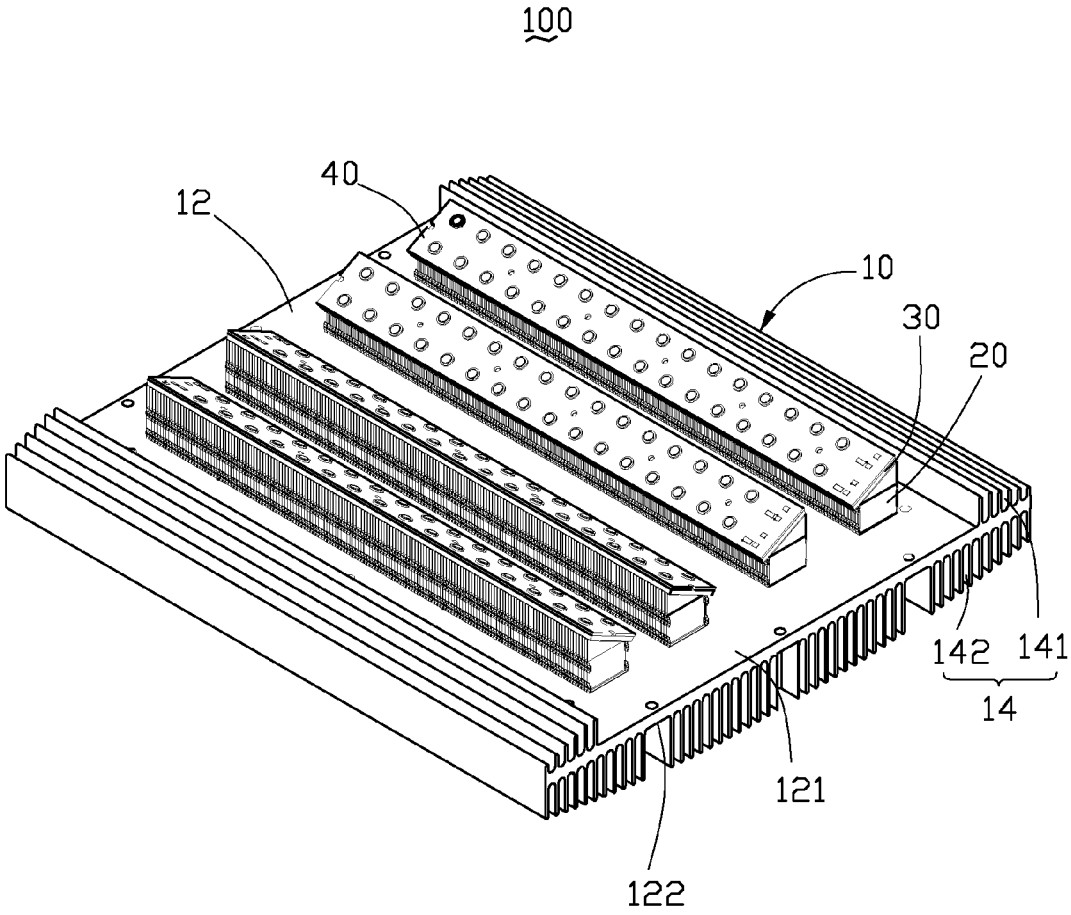
FIG. 1 is an assembled view of an LED lamp in accordance with a preferred embodiment of the disclosure.
Figure 2:
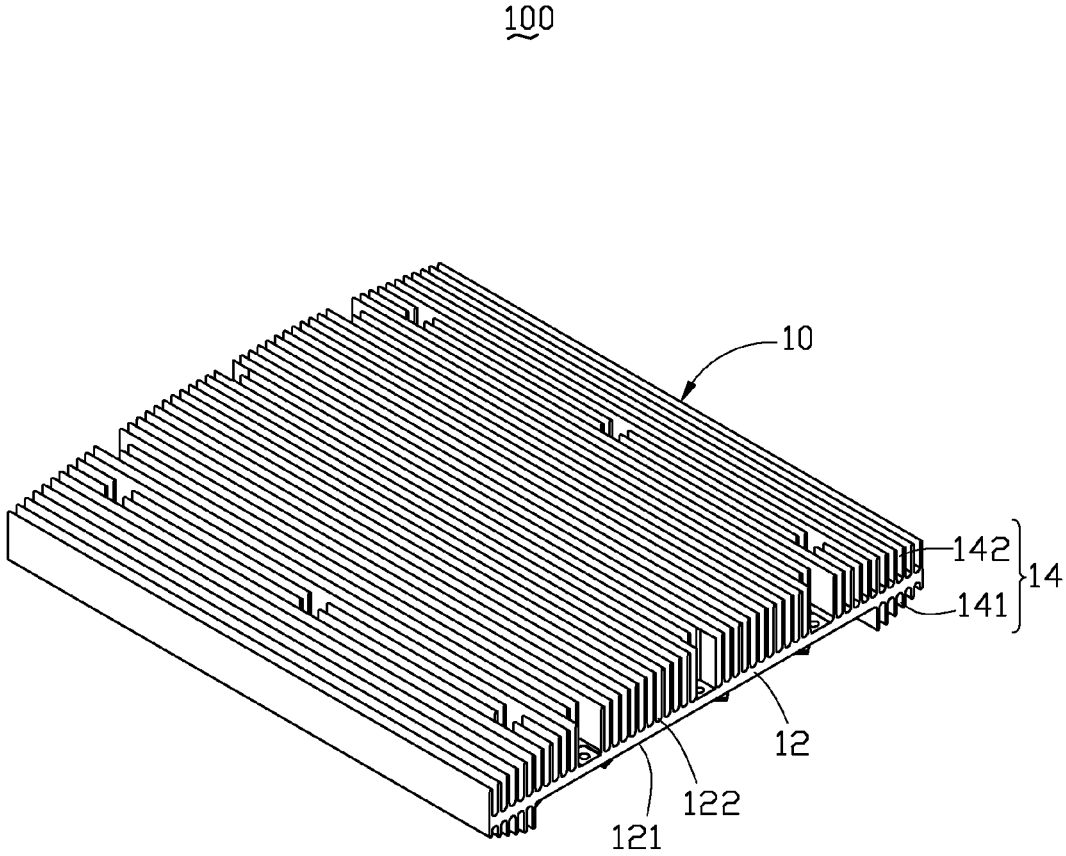
FIG. 2 is an inverted view of the LED lamp of FIG. 1.

Referring to FIGS. 1-2, an LED lamp 100 comprises a heat sink 10, a plurality of fin arrays 20 mounted on a top side of the heat sink 10, a plurality of heat absorbing plates 30 each mounted on a top of a corresponding fin array 20, and a plurality of LED modules 40 each attached to a top of a corresponding heat absorbing plate 30. The heat sink 10 dissipates heat to maintain the LED modules 40 within an acceptable temperature range. The fin arrays 20 receive the LED modules 40 thereon and increase an illumination angle of the LED lamp 100.

The heat absorbing plates 30 are elongated metal. Each LED module 40 comprises an elongated printed circuit board 42 and a plurality of spaced LEDs 44 evenly mounted on a side of the printed circuit board 42. The LEDs 44 of each LED module 40 are arranged along a longitudinal axis of the printed circuit board 42.

The heat sink 10 comprises a base 12 and a plurality of heat dissipating fins 14 integrally extending therefrom, perpendicular to the base 12 and parallel to each other along a longitudinal axis of the heat sink 10. The base 12 has a substantially rectangular shape and a flat top surface 121 and bottom surface 122 opposite thereto. The heat dissipating fins 14 comprise a plurality of first fins 141 extending from two opposite long sides of the top surface 121 of the base 12 and sandwiching the LED modules 40 therebetween. Heights of the first fins 141 gradually decrease along a traverse away from the LED modules 40. The heat dissipating fins 14 further comprise a plurality of second fins 142 extending from the bottom surface 122 of the base 12. Heights of the second fins 142 gradually decrease along the traverse away from a middle portion of the base 12. Outmost first fins 141 are integrally formed with outmost second fins 142, whereby the outmost first and second fins 141, 142 cooperatively form two opposite sidewalls (not labeled) of the heat sink 10.

Figure 3:
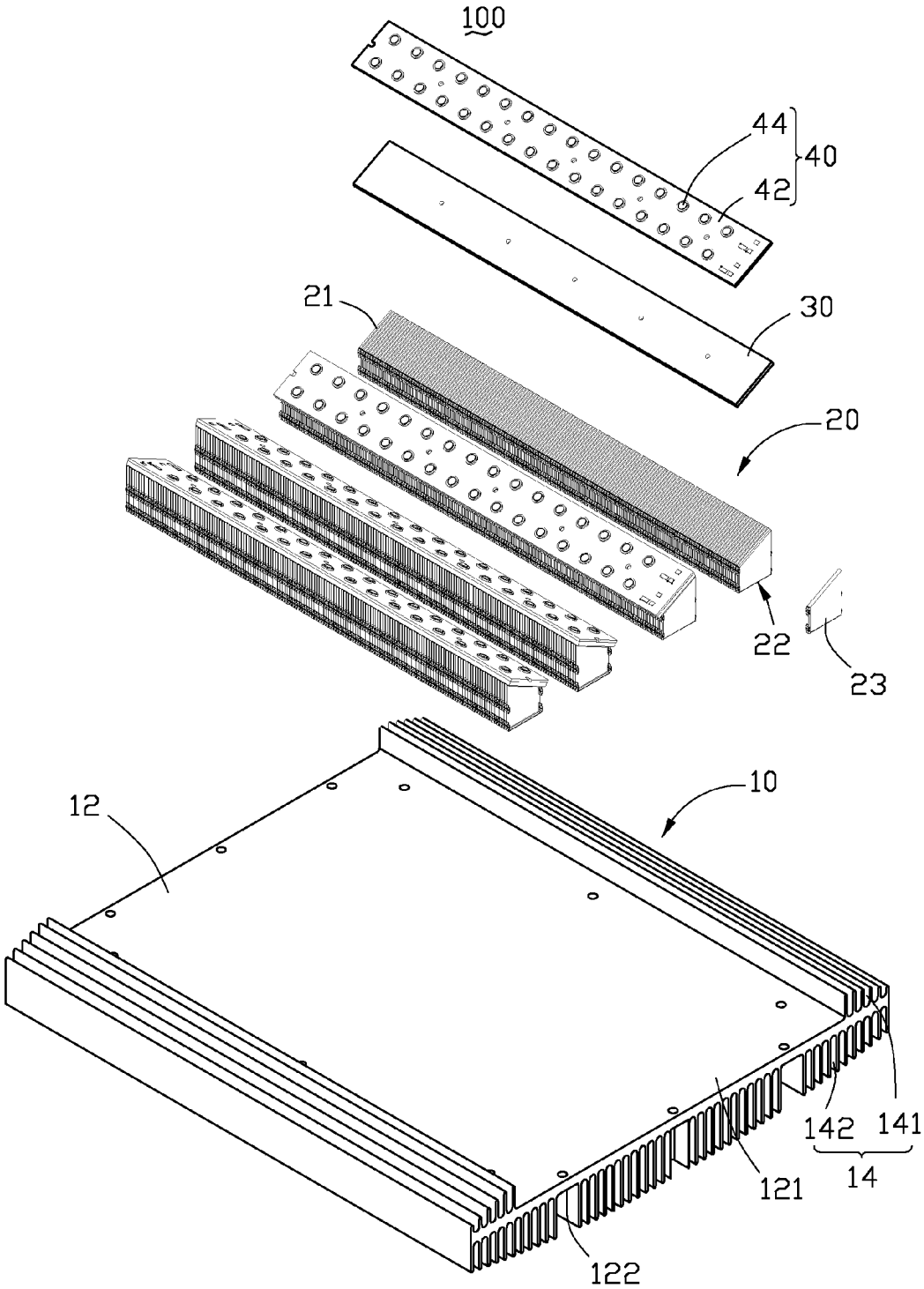
FIG. 3 is an exploded view of the LED lamp of FIG. 1.

Referring to FIG. 3, in this embodiment, the number of fin arrays 20 is four. The fin arrays 20, parallel and spaced apart, are elongated and symmetrical about a central line (not shown) of the top surface 121 of the base 12, which longitudinally extends through a centre of the top surface of the base 12. Each fin array 20 has a bottom mounting surface 22 soldered to the top surface 121 of the base 12 and a top engaging surface 21 angled to the mounting surface 22. An acute angle is defined between the engaging surface 21 and the mounting surface 22.

Figure 4:
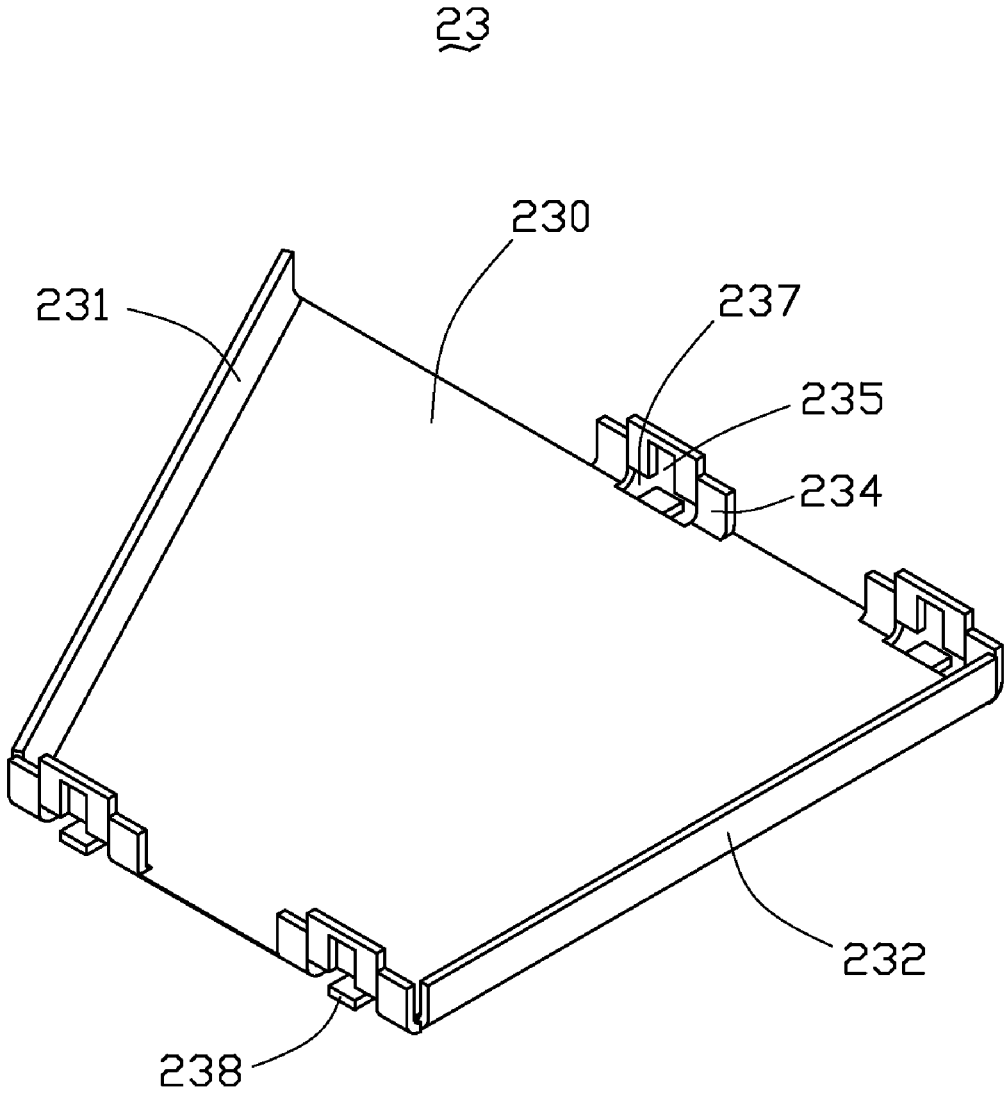
FIG. 4 is an enlarged view of a single fin of the LED lamp of FIG. 3.

Referring to FIG. 4, each of the fin arrays 20 comprises a plurality of fins 23 standing on the top surface 121 of the base 12 and engaging each other. Each fin 23 is metallic and has a trapezoidal main body 230. A top flange 231 is perpendicularly bent from a top edge of the main body 230, and a bottom flange 232 is perpendicularly bent from a bottom edge of the main body 230. Two pairs of tabs 234 extend perpendicularly from lateral sides of the main body 230. The tabs 234 extend perpendicularly in the same direction. A split 237 is defined in a middle of each tab 234 where it adjoins the body 230. A tongue 238 coplanarly extends on the lateral edge of the body 230 and in each of the tabs 234, each tongue 238 being surrounded by a corresponding split 237. A slot 235 is defined in a distal end of each tab 234 and above the corresponding tongue 238 to communicate with the corresponding split 237.

In assembly of the fins 23, the flanges 231, 232 of a fin 23 are aligned with the flanges 231, 232 of an adjacent fin 23. The body 230 of the adjacent fin 23 is pressed towards the fin 23, so that the slots 235 of the tabs 234 of the adjacent fin 23 receive the tongues 238 of the fin 23, firmly attaching adjacent fin 23 thereto. In similar fashion, all the fins 23 are assembled together, with the flanges 231, 232 thereof being coplanar with each other. The top flanges 231 form the engaging surface 21 of each fin array 20, and the bottom flanges 232 form the mounting surface 22 of each fin array 20. Each fin array 20 is thus formed. The fin arrays 20 are mounted on the top surface 121 of the base 12, with the mounting surfaces 22 in contact with the top surface 121. Finally, the heat absorbing plates 30 are mounted on the engaging surfaces 21 of the fin arrays 20, and the LED modules 40 are mounted in a thermally conductive relationship with the heat absorbing plates 30 and the fin arrays 20.

Each engaging surface 21 of the fin array 20 angles upwardly and outwardly from the central line of the top surface 121 of the base 12 toward a corresponding lateral side of the base 12. Each pair of fin arrays 20 symmetrically distributed about the central line of the base 12 have engaging surfaces 21 angling to face the central line of the base 12. In this embodiment, the engaging surfaces 21 of fin arrays 20 are disposed at an identical acute angle with respect to the top surface 121 of the base 12. The LED 44 mounted on the angled engaging surfaces 21 of the fin arrays 20 form a dimensional light source. Thus, the LED lamp 100 has a wider illumination angle than other LED lamps.

In addition, the fins 23 of the fin arrays 20 form air passages (not labeled) therebetween, whereby heat absorbed by the heat absorbing plates 30 from the LED modules 40 can be firstly dissipated by the fins 23 before the heat reaches the heat sink 10 to be dissipated by the heat dissipating fins 14. Thus, the heat of the LED modules 40 can be effectively dissipated to ensure that the LEDs work within the acceptable temperature rang.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a heat sink comprising a base and a plurality of heat dissipating fins extending from the base;

a plurality of fin arrays mounted on a top surface of the base of the heat sink, each fin array having a bottom mounting surface in contact with the top surface of the base and a top engaging surface defined at an acute angle with respect to the top surface of the base; and a plurality of LED modules mounted on the engaging surfaces of the fin arrays, respectively;

wherein each fin array comprises a plurality of secondary fins engaged and parallel to each other, a plurality of air passages being defined between the secondary fins of the each fin array; and wherein from each secondary fin extends a top flange and a bottom flange from a top edge and a bottom edge respectively, the top flanges of the secondary fins forming the engaging surface and the bottom flanges forming the mounting surface.

2. The LED lamp as claimed in claim 1, wherein each secondary fin is trapezoidal.

3. The LED lamp as claimed in claim 1, wherein the secondary fins each define at least a pair of tabs extending perpendicularly from lateral sides thereof to connect with each other.

4. The LED lamp as claimed in claim 1, further comprising a plurality of heat absorbing plates each sandwiched between engaging surfaces of the fin arrays and the LED modules.

5. The LED lamp as claimed in claim 1, wherein the fin arrays are symmetrically distributed on the base about a central line of the base, which extends longitudinally through a centre of the base.

6. The LED lamp as claimed in claim 5, wherein the engaging surfaces of the fin arrays angle to face the central line of the base.

7. The LED lamp as claimed in claim 1, wherein the heat dissipating fins of the heat sink extend from a bottom surface of the base and lateral sides of the top surface of the base.

8. The LED lamp as claimed in claim 7, wherein heights of the heat dissipating fins of the heat sink extending from the bottom surface of the base of the heat sink gradually decrease along an axis away from a central line of the base.

9. An LED lamp comprising:

a heat sink having a flat face;

a plurality of fin arrays each comprising a plurality of fins interlocked together, the fins defining a plurality air passages therebetween, each fin having a first flange and a second flange opposite and angled to the first flange, the first flanges of the fins of each fin array forming a mounting surface in contact with the flat face of the heat sink, the second flanges of the fins of each fin array forming an engaging surface defined at an acute angle with respect to the flat face of the base and the mounting surface of the each fin array; and a plurality of LED modules mounted on the engaging surfaces of the fin arrays to widen illumination area of the LED lamp.

10. The LED lamp as claimed in claim 9, wherein each fin is trapezoidal and each fin array has an elongated configuration.

11. The LED lamp as claimed in claim 9, wherein the fin arrays are symmetrically distributed on the flat face of the heat sink about a central line of the flat face of the heat sink.

12. An LED lamp comprising:

a heat sink comprising a base and a plurality of heat dissipating fins extending from the base;

a plurality of fin arrays mounted on a top surface of the base of the heat sink, each fin array having a bottom mounting surface in contact with the top surface of the base and a top engaging surface defined at an acute angle with respect to the top surface of the base; and a plurality of LED modules mounted on the engaging surfaces of the fin arrays, respectively;

wherein each fin array comprises a plurality of secondary fins engaged and parallel to each other, a plurality of air passages being defined between the secondary fins of the each fin array; and wherein the secondary fins each define at least a pair of tabs extending perpendicularly from lateral sides thereof to connect with each other.

13. The LED lamp as claimed in claim 12, wherein each secondary fin is trapezoidal.

14. The LED lamp as claimed in claim 12, further comprising a plurality of heat absorbing plates each sandwiched between engaging surfaces of the fin arrays and the LED modules.

15. The LED lamp as claimed in claim 12, wherein the fin arrays are symmetrically distributed on the base about a central line of the base, which extends longitudinally through a centre of the base.

16. The LED lamp as claimed in claim 15, wherein the engaging surfaces of the fin arrays angle to face the central line of the base.

17. The LED lamp as claimed in claim 12, wherein the heat dissipating fins of the heat sink extend from a bottom surface of the base and lateral sides of the top surface of the base.

18. The LED lamp as claimed in claim 17, wherein heights of the heat dissipating fins of the heat sink extending from the bottom surface of the base of the heat sink gradually decrease along an axis away from a central line of the base.

* * * * *